US006720726B1

(12) United States Patent
Kimiya et al.

(10) Patent No.: US 6,720,726 B1
(45) Date of Patent: Apr. 13, 2004

(54) COLOR CATHODE RAY TUBE

(75) Inventors: Junichi Kimiya, Kumagaya (JP); Shunji Ookubo, Kumagaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 117 days.

(21) Appl. No.: 09/718,484

(22) Filed: Nov. 24, 2000

(30) Foreign Application Priority Data

Nov. 25, 1999 (JP) ..... 11-334599

(51) Int. Cl.[7] ..... H01J 29/50
(52) U.S. Cl. ..... 313/448; 313/449; 313/414
(58) Field of Search ..... 313/412, 414, 313/447, 448, 449; 315/15

(56) References Cited

U.S. PATENT DOCUMENTS 2,988,658 A * 6/1961 Skellet ..... 313/103 R
4,712,043 A 12/1987 Takenaka et al.
5,466,983 A * 11/1995 Shirai et al. ..... 313/414
6,016,030 A 1/2000 Amano et al.

FOREIGN PATENT DOCUMENTS

JP 8-22780 1/1996
JP 9-320485 12/1997

* cited by examiner

*Primary Examiner*—NimeshKumar D. Patel
*Assistant Examiner*—Glenn Zimmerman
(74) *Attorney, Agent, or Firm*—Oblon, Spivak, McClelland, Maier & Neustadt, P.C.

(57) ABSTRACT

In an electron gun assembly, its main convergence lens is composed of a focus electrode to which a focus voltage is applied, an anode electrode to which a high anode voltage is applied, and an intermediate electrode which is provided between the focus and anode electrodes and to which a high intermediate potential higher than the focus voltage and lower than the anode voltage is applied. The anode and intermediate electrodes are each a cylindrical unit long in the in-line direction. In the direction crossing at right angles with the in-line direction of the cylindrical units, the diameter of the opening in the anode electrode is set smaller than that of the opening in the intermediate electrode, thereby forming a multiple pole lens into a main electron lens of large aperture.

2 Claims, 6 Drawing Sheets

COLOR CATHODE RAY TUBE

CROSS-REFERENCE TO RELATED APPLICATIONS

This application is based upon and claims the benefit of priority from the prior Japanese Patent Application No. 11-334599, filed Nov. 25, 1999, the entire contents of which are incorporated herein by reference.

BACKGROUND OF THE INVENTION

This invention relates to an electron gun assembly for a color cathode ray tube, and more particularly to a color cathode ray tube provided with an electron gun assembly having a main electron lens of large aperture.

Generally, a color cathode ray tube has an external enclosure or envelope composed of a panel 11 and a funnel 12 integrally joined to the panel 11 as shown in FIG. 1. On the inside face of the panel 11, a phosphor screen or target 13 composed of a stripe-like or dot-like three-color phosphor layers that emits blue light rays, green light rays, and red light rays are formed. Inside the phosphor screen 13, a shadow mask 14 in which a large number of apertures have been made is provided in such a manner that the mask faces the screen. On the other hand, in the neck 15 of the funnel 12, an electron gun assembly 17 is provided which emits three electron beams 16B, 16G, and 16R. The three electron beams 16B, 16G, and 16R emitted from the electron gun assembly 17 are deflected by a horizontal and a vertical deflecting magnetic field generated by a deflection yoke 18 provided on the outside of the funnel 12 and are directed via the shadow mask 14 toward the phosphor screen 13. The phosphor screen 13 is scanned horizontally and vertically by the electron beams, thereby displaying a color image.

In recent years, there have been strong demands for higher resolution of color images. The spot diameter of an electron beam formed on the phosphor screen 13 is considered to be a major factor that determines resolution. The electron beam spot diameter is generally determined by the focusing capability of the electron gun assembly.

The focusing capability is generally determined by the diameter of the main electron lens, the hypothetical object point diameter, the magnification, and others. Specifically, the larger the diameter of the main electron lens is, the smaller the hypothetical object point diameter is, or the lower the magnification is, the smaller the electron beam spot diameter becomes, which improves the resolution.

In a conventional electron gun assembly, for example, the electron gun assembly disclosed in, for example, U.S. Pat. No. 4,712,043, Jpn. Pat. Appln. KOKAI Publication No. 8-22780, or Jpn. Pat. Appln. KOKAI Publication No. 9-320485, an intermediate electrode to which about an intermediate potential higher than the focus voltage and lower than the anode voltage is supplied is provided between the focus electrode and anode electrode. In the respective opposite faces, an opening with an elliptical section long in the in-line direction has been made so as to be common to three electron beams.

In the electron gun assembly having such a configuration, the main electron lens of large aperture has been formed by forming not only an expanded electric field in the direction of electron beam advance but also a continuous electric field in the in-line direction. With the electron gun assembly, the main electron lens of large aperture makes smaller the electron beam spot converged on the screen, realizing a high resolution.

In the electron gun assembly with such a configuration, however, the electrode in which an opening with an elliptical section long in the in-line direction has been made so as to be common to three electron beams causes side beams to converge, with great halos occurring in the direction of the center beam as shown in FIG. 2. To avoid this phenomenon, one approach is to design an electrode structure in designing an electron gun assembly so that side beams may be bent toward the center beam beforehand so as to enter the main electron lens of large aperture at an angle. With the electrode structure thus designed, side beams are caused to enter the main electron lens at an angle, with the result that the side beams pass through the parts where the potential distribution is relatively uniform closer to the center beam within the main electron lens. As a result of the side beams entering the main electron lens at an angle, its spherical aberration is increased, which is balanced against the spherical aberration occurred on the opposite side, with the result that the side beams are prevented from being converged in a state where great halos appear in the direction of the center beam as shown in FIG. 2.

However, with the electrode structure that causes side beams to enter the main electron lens at an angle, since side beams are bent before they enter the main electron lens, the center of the side beam through-hole, for example, the center of the side beam through-hole in each of the second grid and third grid, or the center of a sub-lens composed of the third, fourth, and fifth grids, has been offset.

In the former case where the center of the side beam through-hole in each of the second and third grids has been offset, when the side beams are bent toward the center beam, an aberration occurs in the side beams between the second grid and third grid, regardless of the great potential difference, because the diameter of the opening is small. This causes the problem of the side beams being distorted seriously. In the latter case where the center of the sub-lens composed of the third, fourth, and fifth grids has been offset, the shape of inner core pins necessary to assemble the electrodes constituting an electron gun assembly must be made complex, which causes the problem of making errors more liable to occur in assembly.

In the main electron lens of large aperture described above, since the shape of the opening between the electrodes is of an elliptical section long in the horizontal direction, the lens diameter in the vertical direction is much smaller than that in the horizontal direction, causing the electron beam spot on the screen to be converged excessively in the vertical direction and insufficiently in the horizontal direction. To overcome this problem, an electric field correcting electrode plate is provided in a position back from the opening in the focus electrode. Each hole corresponding to each of the three electron beams made in the electric field correcting electrode plate is formed into a shape with its height much greater than its width.

As described above, the horizontal diameter of each of the holes corresponding to the respective three electron beams is set small, which corrects insufficient convergence in the horizontal direction and excessive convergence in the vertical direction. However, as a result of the horizontal diameter of each of the holes corresponding to the respective three electron beams being set small, when the electron beams pass through the holes, the holes give local aberrations to the electron beams. This impairs seriously the original effect of the main electron lens of large aperture produced by expanding the lens electric field in the horizontal direction and in the direction of electron beam advance and thereby forming the main electron lens.

Furthermore, there is a limit to the length of the intermediate electrode forming the main electron lens of large aperture. When the intermediate electrode is too long, the lens electric field is divided, practically forming separate electric field lenses between the fifth grid and intermediate electrode GM and between the intermediate electrode GM and the sixth electrode G6 as shown in FIG. 3B, which increases the lens aberration. As a result, the electron beam spot diameter becomes larger, degrading the resolution.

BRIEF SUMMARY OF THE INVENTION

The object of the present invention is to provide an electron gun assembly which not only makes the aperture of the main electron lens larger while alleviating the aberration in the main electron lens, but also assures a high assembly accuracy and a good image characteristic all over the screen.

According to the present invention, there is provided a color cathode ray tube comprising: an electron gun assembly including an electron beam generating section for emitting and forming three electron beams in in-line arrangement and a main electron lens section for converging the electron beams on a screen; and a deflection yoke for generating a deflection magnetic field to deflect the election beams emitted from the electron gun assembly in the horizontal and vertical directions for scanning on a screen, wherein the main convergence lens of the electron gun assembly includes a focus electrode to which a medium focus voltage is applied, an anode electrode to which a high anode voltage is applied, and at least one intermediate electrode which is provided between the focus electrode and anode electrode and to which a medium high intermediate potential is applied, the intermediate potential being higher than the medium focus voltage and lower than the high anode voltage and obtained by dividing the high anode potential with a resistor provided near the electron gun assembly, and the opening sections of the anode electrode and intermediate electrode adjacent to each other are each a cylindrical unit long in the in-line direction and common to the three electron beams and have a multiple pole lens provided between the anode electrode and intermediate electrode adjacent to each other, the multiple pole lens acting equally on the three electron beams and diverging them relatively in the vertical direction and converging them relatively in the horizontal direction.

Furthermore, the color cathode ray tube is characterized in that the opening sections of the anode electrode and intermediate electrode adjacent to each other are each a cylindrical unit long in the in-line direction and common to the three electron beams, with the diameter of the openings in the direction crossing at right angles with the in-line direction of the cylindrical units being such that the diameter of the opening in the anode electrode is set smaller than that of the opening in the intermediate electrode to form a multiple pole lens common to the three electron beams.

FIGS. 4A, 4B, and 4C show the potential distribution in a conventional main electron lens of large aperture, a graph of a quadratic differential of the potential on the tube axis, and the trajectories of side beams in the main electron lens of large aperture. FIGS. 5A, 5B, and 5C show the potential distribution in a main electron lens of large aperture according to the present invention, a graph of a quadratic differential of the potential on the tube axis, and the trajectories of side beams in the main electron lens of large aperture. In FIGS. 4A and 4C and FIGS. 5B and 5C, the fifth grid corresponds to the focus electrode G5 and the sixth grid G6 corresponds to the anode electrode. Between the fifth and sixth grids G5, G6, the intermediate electrode GM is provided.

FIG. 4A and FIG. 5A schematically show a potential distribution occurring in the conventional main electron lens of large aperture and that of the present invention, respectively. As seen from FIG. 4A and FIG. 5A, the anode electrode G6 and intermediate electrode GM adjacent to each other in the color cathode ray tube of the present invention are each a cylindrical unit long in the in-line direction and common to three electron beams. As for the diameter of the openings in the direction crossing at right angles with the in-line direction (horizontal direction), the diameter of the opening in the anode electrode is set smaller than that of the opening in the intermediate electrode.

With such a configuration, a multiple pole lens that acts equally on three electron beams and converges them relatively in the horizontal direction and diverges them relatively in the vertical direction is formed between the anode electrode G6 and intermediate electrode GM adjacent to each other. As a result, the electric field penetrating into the intermediate electrode is pressed by the face of the anode electrode facing the intermediate electrode, making the potential in the intermediate electrode denser than in the prior art. Consequently, the lens between the focus electrode G5 and intermediate electrode GM and the lens between the intermediate electrode GM and anode electrode G6 can be easily formed as a continuous single lens as compared with an electronic lens system using a conventional electrode structure. In the prior art (as disclosed in Japanese Patent Application No. 11-131469), to connect two lenses formed in front of and behind the intermediate electrode to form a continuous single lens of large aperture, the length L of the intermediate electrode in the direction of electron beam advance should be restricted by the short diameter DV (the diameter in the vertical direction) of the opening in front of and behind the intermediate electrode, where DV satisfies the following expression:

$$0.3 \leq DV/L \text{ 23 } 0.6$$

With the configuration of the present invention, however, the density of the electrical potential is increased in the intermediate electrodes so that the two consecutive lenses in front of and behind the intermediate electrode can be easily connected to each other, which make it possible to make greater the length of the intermediate electrode in the direction of electron beam advance, without cutting off the connection.

FIG. 4B and FIG. 5B show graphs of the state of potential (Vo) changes as a result of a quadratic differential of the potential (Vo") on the tube axis in the prior art and in the present invention, respectively. The graphs of a quadratic differential of the potential on the tube axis show convergence regions and divergence region in the main electron lens of large aperture. In the conventional main electron lens of large aperture in FIG. 4B, a quadratic differential of the potential on the tube axis changes from a convergence region to a divergence region in the direction of electron beam advance. Near the midpoint, however, the main electron lens becomes such a lens as alternates between a divergence region and a convergence region, with the result that the main electron lens becomes a lens which effects convergence, divergence, convergence, and divergence in that order. A lens system that alternates between convergence and divergence this way is considered to be undesirable because it increases the lens aberration. In contrast, a quadratic differential of the potential on the tube axis according to the present invention changes from a convergence region to a divergence region in the direction of electron beam advance. Although the quadratic differential changes a little up and down near the midpoint, all the changes take place in convergence regions, with the result that the main electron lens becomes a lens with only one set of convergence and divergence. As a result, the main electron lens of large aperture according to the present invention can progressively prevents the lens aberration from increasing when the length of the intermediate electrode is increased, as compared with the conventional main electron lens of large aperture. The observation of a quadratic differential of the potential on the axis has shown that the divergence region rises sharply. This is because the bump (concave) in the intermediate part has shifted toward the convergence side as compared with that in the prior art, and the lens effect has increased in the divergence region to maintain a balance as a lens. It is assumed that such a sharp rise in the divergence region become to have the effect of offsetting the aberration occurred in the convergence region, with the result that the aperture of the lens becomes large.

FIG. 4C and FIG. 5C show the trajectories of side beams in the main electron lens of large aperture in the prior art and in the present invention, respectively. Specifically, with the conventional electrode structure, to remove the halo components from the side beams and concentrate the three electron beams on the screen, the side beams have to be bent toward the center beam before entering the main electron lens of large aperture. Because of this, the center of a side beam through-hole, for example, the center of each of the side beam through-holes of the second and third grids, or the center of the sub-lens composed of the third, fourth, and fifth grids, has been designed to be offset. With the center of the side beam through-hole of each of the second and third grids being offset, since the diameter of the aperture is small for the large potential difference between the second and third grids, an aberration occurs when the side beams are bent toward the center beam, with the result that the side beams are distorted seriously. In addition, when the center of the sub-lens composed of the third, fourth, and fifth grids has been offset, this makes it necessary to complicate the shape of the inner core pin needed in assembling the electrodes constituting an electron gun assembly, which causes the problem of making errors liable to occur in assembly.

With the present invention, however, since the main electron lens of large aperture has the function of bending the side beams toward the center beam positively, the side beams have only to be bent a little toward the center beam before entering the main electron lens of large aperture, or there is no need to bend the side beams toward the center beam. Consequently, the aberration occurred in bending the side bean toward the center beam between the second and third grids is alleviated (or eliminated). Furthermore, this provides the advantage of making it unnecessary to complicate the shape of the inner core pin needed in assembling the electrodes constituting an electron gun assembly.

On the other hand, in the conventional main electron lens of large aperture, since the opening between the electrodes has an elliptical shape in section long in the horizontal direction, the diameter of the lens in the vertical direction is much smaller than the diameter of the lens in the horizontal direction, with the result that the electron beam spot on the screen converges excessively in the vertical direction and insufficiently in the horizontal direction. To correct this phenomenon, an electric field correcting electrode plate is provided in a position back from the opening of the focus electrode. Holes made separately for three electron beams in the electric field correcting electrode plate are made extremely long vertically for their width. In this way, making the diameter of the holes formed for the respective three electron beams is made smaller in the horizontal direction corrects insufficient convergence in the horizontal direction and excessive convergence in the vertical direction. As a result of making smaller the horizontal diameter of the holes formed for the respective three electron beams, local aberration components are given at the holes when the electron beams pass through the holes. This causes the lens electric field to expand in the horizontal direction and in the direction of electron beam advance, which impairs seriously the effect of forming the main electron lens of large aperture. With the present invention, however, since the convergence lens components, which are common to three electron beams and diverge relatively in the vertical direction and converge relatively in the horizontal direction, lie between the anode electrode G6 and intermediate electrode GM. Therefore, it is not necessary to make extremely small the horizontal diameter of the holes made in the electric field correcting electrode plate provided in the position back from the opening in the focus electrode, thereby alleviating the local aberration components at the holes made for the respective three electron beams in the electric field correcting electrode plate provided in the position back from the opening of the focus electrode.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 6A:
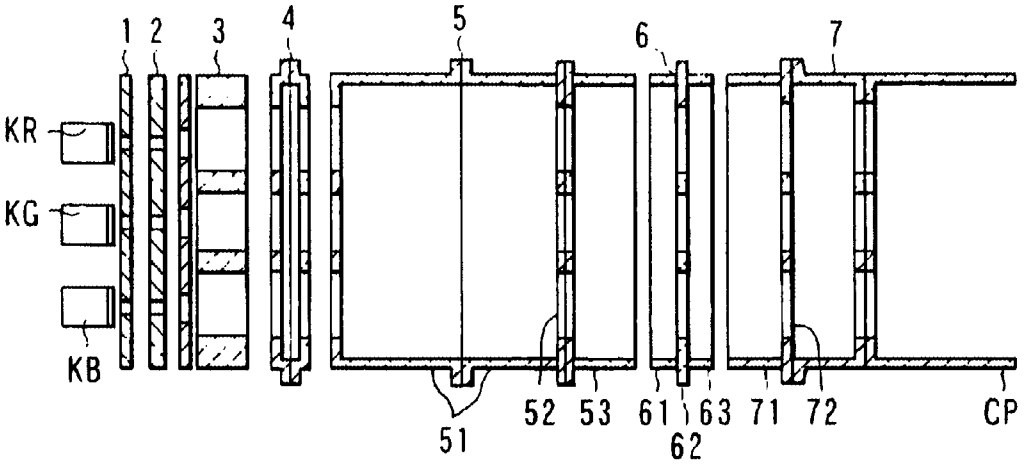
FIGS. 6A and 6B are schematic sectional views showing the configuration of the electron gun assembly provided in the color cathode ray tube according to the embodiment.
Figure 6B:
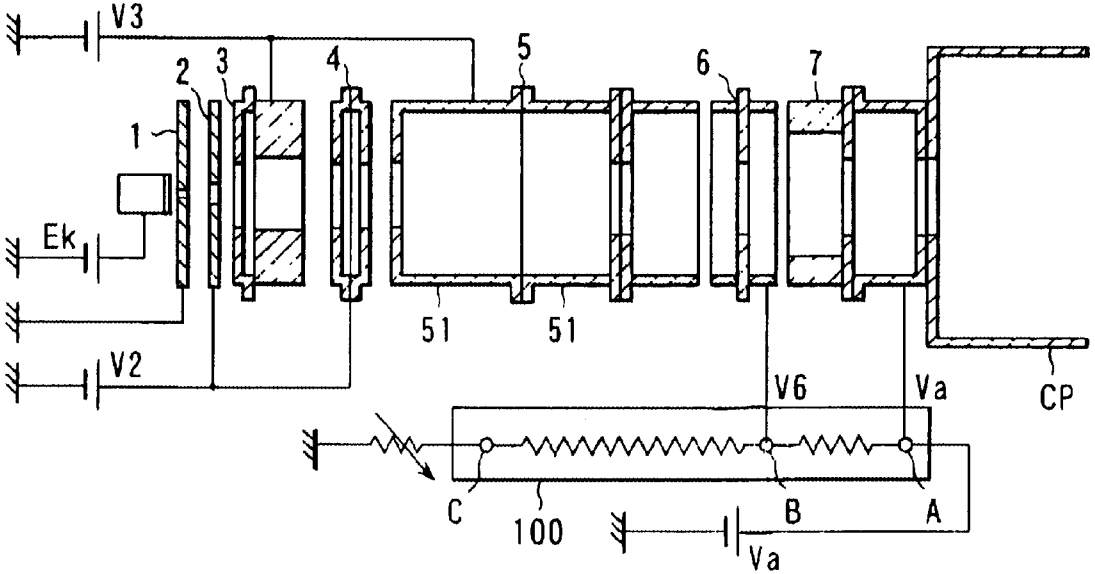

FIGS. 6A and 6B are schematic sectional views of the electron gun assembly part of a cathode ray tube according to an embodiment of the present invention. In an electron gun assembly shown in FIG. 6A, three cathodes (KB), (KG), (KR) at voltage $E_k$ and that each include a heater (not shown) and generate an electron beam, a grounded first grid 1, a second grid 2 at voltage V2, a third grid 3 at voltage V3, a fourth grid 4 at the voltage V2, a fifth grid (focus electrode) 5 at the voltage V3, a sixth grid (intermediate electrode) 6, a seventh grid (anode electrode) 7, and a convergence cup CP are arranged in that order. These electrodes are supported by an insulating support (not shown) in such a manner that they are secured to the support.

In the vicinity of the electron gun assembly, a resistor 100 is provided as shown in FIG. 6B. One end A of the resistor 100 at voltage Va is connected to the seventh grid (anode electrode) 7. The other end C of the resistor 100 is connected to a variable resistor outside the tube and then is grounded. An intermediate point B on the resistor 100 at voltage V6 is connected to the sixth grid (intermediate electrode) 6. A medium high voltage lower than the anode voltage Eb applied to the convergence cup CP and higher than the medium focus voltage (V3) applied to the fifth grid (focus electrode) 5 is applied to the intermediate point B.

Figure 7A:
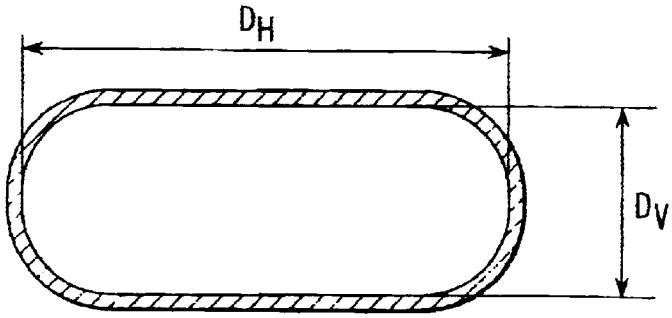
FIGS. 7A to 7E are sectional views showing the shape of an electrode used in the electron gun assembly provided in the color cathode ray tube according to the embodiment.
Figure 7B:
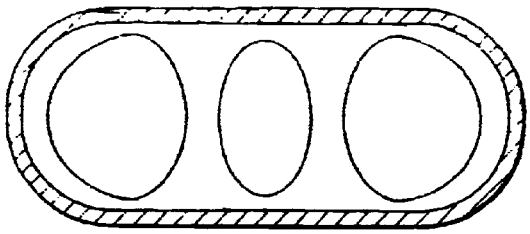
Figure 7C:
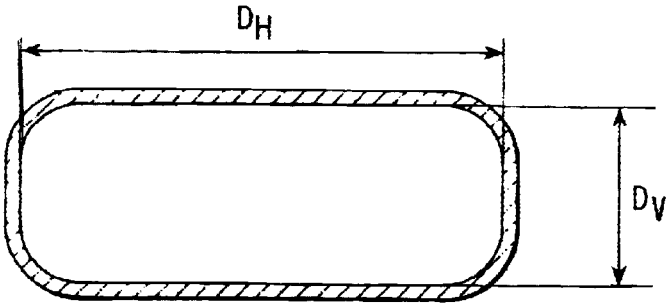
Figure 7D:
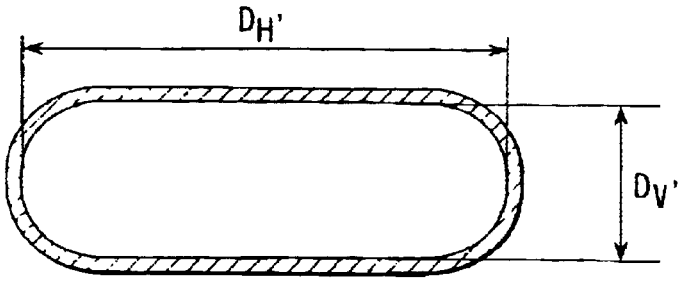
Figure 7E:
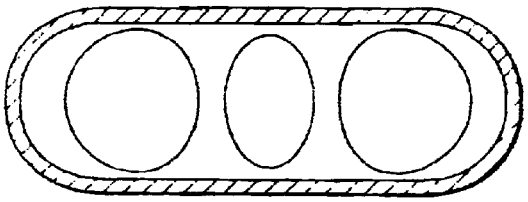

The first grid 1 is a thin plate electrode. In the first grid, three electron beam-through-holes of small diameter have been bored. Similarly, the second grid 2 is a thin plate electrode, in which three electron beam through-holes of small diameter have been bored. The third grid 3 is a combination of a cup-shaped electrode and a thick plate electrode. On the second grid 2 side, three electron beam through-holes of a little larger diameter than that of the second grid electron beam through-holes have been bored, whereas on the fourth grid 4 side, three electron passing beam holes of large diameter have been bored. The fourth grid G4 is formed by joining the open ends of two cup-shaped electrodes together. In each of the cup-shaped electrodes, three electron beam through-holes of large diameter have been bored. The fifth grid (focus electrode) 5 is composed of two cup-shaped electrodes 51 long in the direction in which the electron beam passes through, a plate-like electrode 52, and a cylindrical electrode 53 with an opening common to three electron beams as shown in FIG. 7A. When the fifth grid (focus electrode) 5 is viewed from the sixth grid (intermediate electrode) 6 side, the fifth grid has been formed into a shape as shown in FIG. 7B. The sixth grid (intermediate electrode) 6 is so constructed that a plate-like electrode 62 in which three electron beam through-holes have been bored is sandwiched between two cylindrical electrodes 61 and 63, each with an opening common to three electron beams as shown in FIG. 7A. When the electrode is viewed from the fifth grid (focus electrode) 5 side, or from the seventh grid (anode electrode) 7 side, it has been formed into a shape as shown in FIG. 7B. In the seventh grid (anode electrode) 7, a cylindrical electrode 71 with an opening common to three electron beams as shown in FIG. 7D and a plate-like electrode 72 in which three electron beam through-holes have been bored are arranged in that order. When the seventh grid (anode electrode) 7 is viewed from the sixth grid (intermediate electrode) 6 side, it has been formed into a shape as shown in FIG. 7E.

Specifically, if the diameter of the opening in the sixth grid (intermediate electrode) 6 on the seventh grid (anode electrode) 7 side is expressed by the horizontal diameter=DH and the vertical diameter=DV and the diameter of the opening in the seventh grid (anode electrode) 7 on the sixth grid (intermediate electrode) 6 side is expressed by the horizontal diameter=DH' and the vertical diameter=DV', these diameters are determined so as to fulfill the following expressions:

$$DH=DH'$$

$$DV>DV'$$

With such a configuration, a multiple pole lens that is common to the three electron beams and converges them relatively in the horizontal direction and diverges them relatively in the vertical direction is formed between the seventh grid (anode electrode) 7 and sixth grid (intermediate electrode) 6 adjacent to each other. Since the diameter of the opening in the seventh grid (anode electrode) 7 in the vertical direction is smaller than the diameter of the opening in the sixth grid (intermediate electrode) 6, the electric field penetrating into the sixth grid (intermediate electrode) 6 is pressed by the opposite face of the seventh grid (anode electrode) 7 to the sixth grid (intermediate electrode) 6, with the result that the potential inside the sixth grid (intermediate electrode) 6 is denser than that in the prior art. As a result, the lens between the fifth grid (focus electrode) 5 and sixth grid (intermediate electrode) 6 can be easily connected to the lens between the sixth grid (intermediate electrode) 6 and seventh grid (anode electrode) 7 to form a continuous lens as compared with those in the prior art.

In the prior art, the length L of the sixth grid (intermediate electrode) in the direction of electron beam advance to connect the two lenses in front of and behind the sixth grid (intermediate electrode) 6 to each other to form a continuous lens of large aperture is limited by the short diameter Dv of the opening in front of and behind the sixth grid (intermediate electrode) 6. As disclosed in Japanese Patent Application No. 11-131469, it is desirable that DV should satisfy the following expression:

$$0.3 \leqq DV/L \leqq 0.6$$

With the configuration of the present invention, however, the connection of two consecutive lenses in front of and behind the sixth grid (intermediate electrode) 6 becomes much better, which makes it possible to make greater the length of the sixth grid (intermediate electrode) 6 in the direction of electron beam advance, without separating the two lenses.

Figure 1:
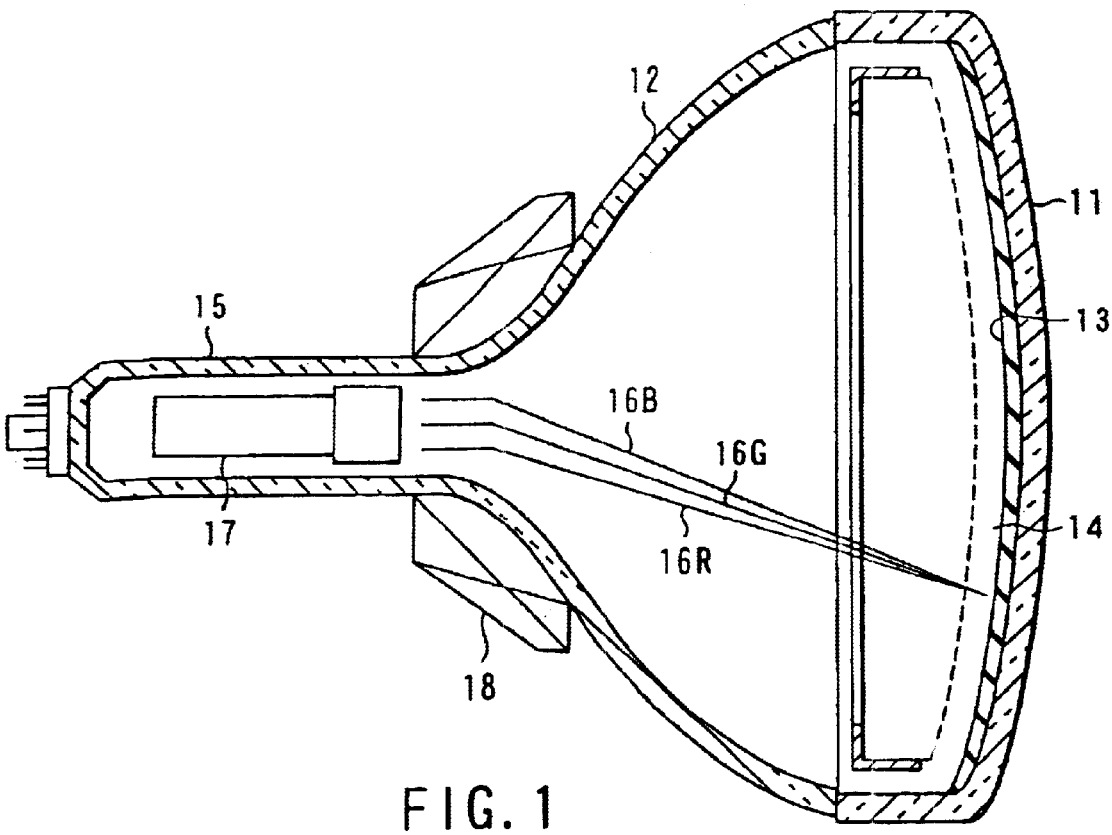
FIG. 1 PRIOR ART
FIG. 1 is a schematic sectional view of a general color cathode ray tube.
Figure 2:
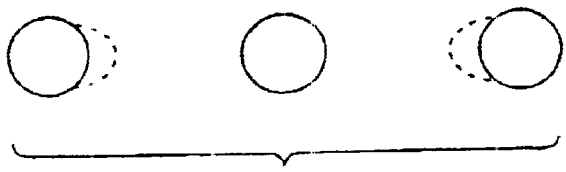
FIG. 2 PRIOR ART
FIG. 2 shows a haloed state of side beams in a conventional color cathode ray tube.
Figure 3A:
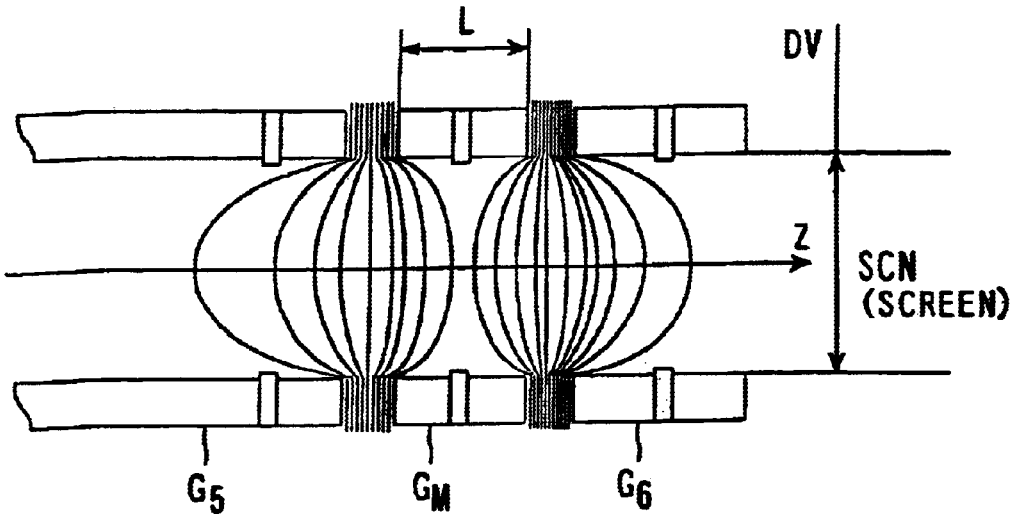
FIG. 3A PRIOR ART
FIGS. 3A and 3B schematically show the potential distribution in the main electron lens and the state of the lens in the conventional color cathode ray tube.
Figure 3B:
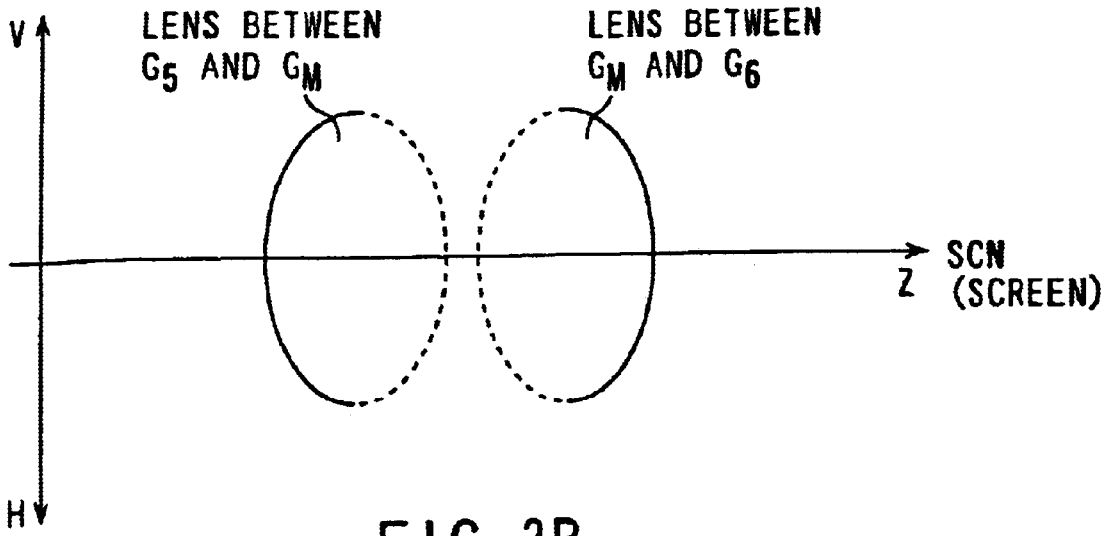
FIG. 3B PRIOR ART
Figure 4A:
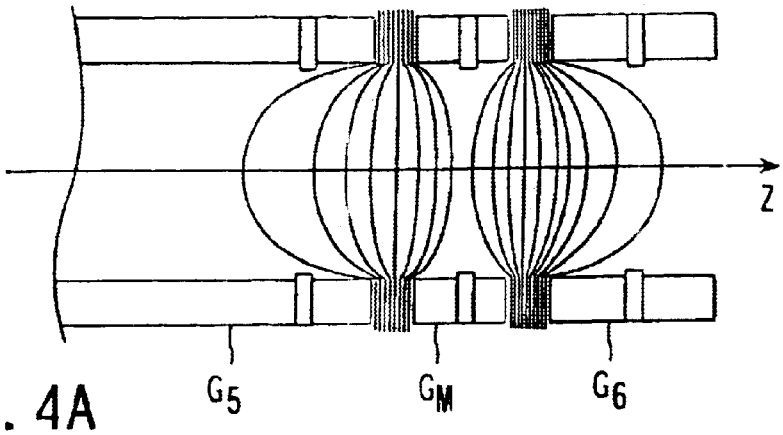
FIG. 4A PRIOR ART
FIG. 4A shows the potential distribution in the main electron lens section of an electron gun assembly provided in the conventional color cathode ray tube.
Figure 4B:
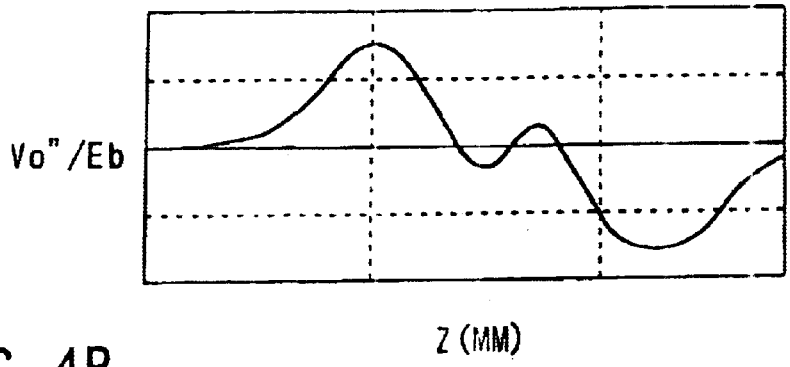
FIG. 4B PRIOR ART
FIG. 4B shows a quadratic differential of the potential on the axis of the main electron lens section of the electron gun assembly provided in the conventional color cathode ray tube.
Figure 4C:
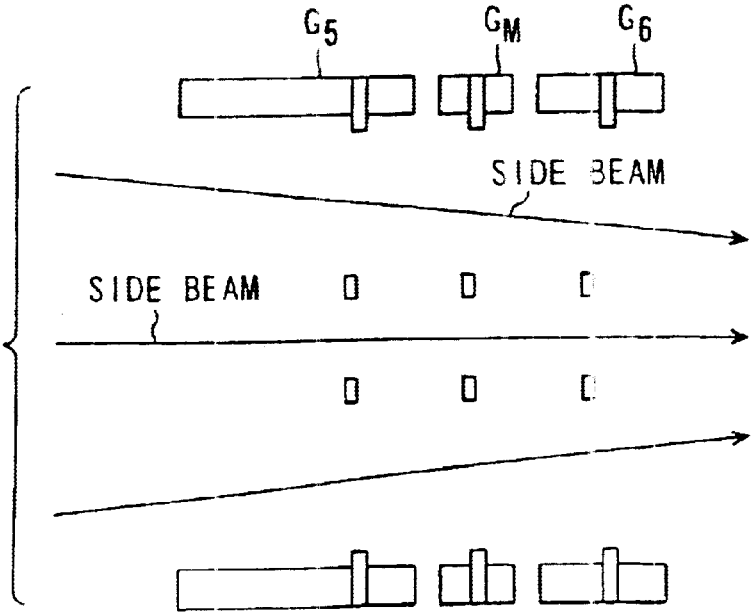
FIG. 4C PRIOR ART
FIG. 4C shows the trajectories of side beams passing through the main electron lens section of the electron gun assembly provided in the conventional color cathode ray tube.
Figure 5A:
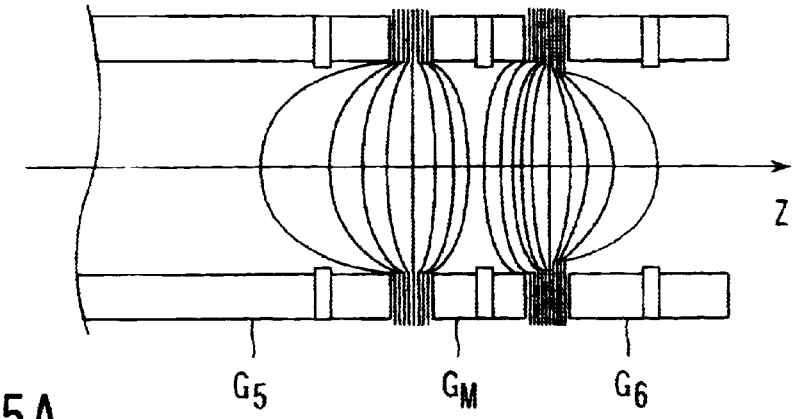
FIG. 5A shows the potential distribution in the main electron lens section of an electron gun assembly provided in a color cathode ray tube according to an embodiment of the present invention.
Figure 5B:
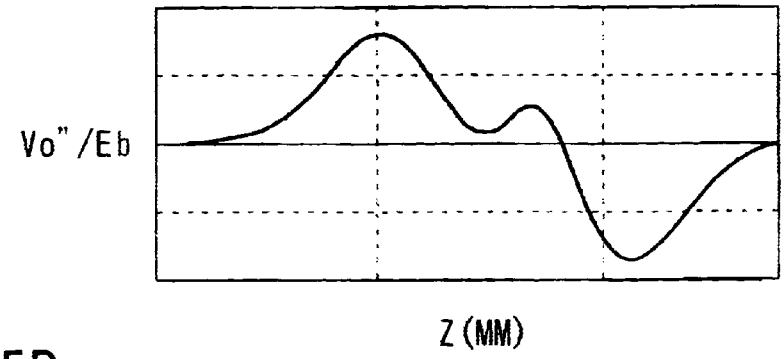
FIG. 5B shows a quadratic differential of the potential on the axis of the main electron lens section of the electron gun assembly provided in the color cathode ray tube according to the embodiment.
Figure 5C:
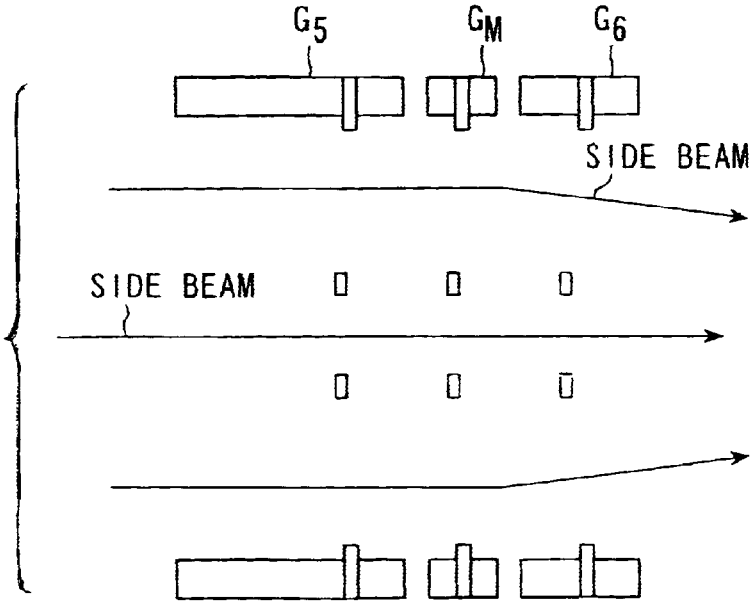
FIG. 5C shows the trajectories of side beams passing through the main electron lens section of the electron gun assembly provided in the color cathode ray tube according to the embodiment.

The effect of improving the connection between the two lenses in front of and behind the sixth grid (intermediate electrode) 6 can be explained using a quadratic differential of the potential on the tube axis. FIGS. 4B and 5B are graphs of a quadratic differential of the potential on the tube axis in the prior art and in the present invention, respectively. The graphs of a quadratic differential of the potential on the tube axis show convergence regions and divergence regions of the main electron lens of large aperture. In the conventional main electron lens of large aperture in FIG. 4B, a quadratic differential of the potential on the tube axis changes from a convergence region to a divergence region in the direction of electron beam advance. Near the midpoint, however, the main electron lens becomes such a lens as alternates between a divergence region and a convergence region, with the result that the main electron lens becomes a lens which effects convergence, divergence, convergence, and divergence in that order. A lens system that alternates between convergence and divergence is considered to be undesirable because it increases the lens aberration. In contrast, a quadratic differential of the potential on the tube axis according to the present invention changes from a convergence region to a divergence region in the direction of electron beam advance. Although the quadratic differential changes a little up and down near the midpoint, all the changes take place in convergence regions, with the result that the main electron lens becomes a lens with only one Set of convergence and divergence. As a result, the main electron lens of large aperture according to the present invention can progressively prevent the lens aberration from increasing when the length of the intermediate electrode is increased. The observation of a quadratic differential of the potential on the axis has shown that the divergence region rises sharply. This is because the bump (concave) in the intermediate part has shifted toward the convergence side as compared with that in the prior art, and the lens effect has increased in the divergence region to maintain a balance as a lens. It is assumed that such a sharp rise in the divergence region become to have the effect of offsetting the aberration occurred in the convergence region, with the result that the aperture of the lens becomes large.

In the prior art, to remove the halo components from the side beams and concentrate the three electron beams on the screen, the side beams have to be bent toward the center beam before entering the main electron lens of large aperture, which requires the center of a side beam through-hole, for example, the center of each of the side beam through-holes in the second and third grids, or the center of the sub-lens composed of the third, fourth, and fifth grids, to be offset. With the center of the side beam through-hole in each of the second and third grids being offset, since the diameter of the opening is small between the second and third grids, although the potential difference is great, the following problem arises: an aberration occurs when the side beams are bent toward the center beam and the side beams are distorted seriously. In addition, when the center of the sublease composed of the third, fourth, and fifth grids is offset, this makes it necessary to complicate the shape of the inner core pin needed in assembling the electrodes constituting an electron gun assembly, which causes the problem of making errors liable to occur in assembly. With the present invention, however, a multiple pole lens, which is common to the three electron beams and effects converges them relatively in the horizontal direction and diverges them relatively in the vertical direction, is formed between the seventh grid (anode electrode) 7 and sixth grid (intermediate grid) 6 adjacent to each other. Since the main electron lens of large aperture has the function of bending side beams toward the center beam positively, the amount of the bend of a side beam toward the center beam before causing the side beam to enter the main electron lens is small (or there is no need; to bend the side beam). Consequently, the aberration occurred in bending the side beam toward the center beam between the second and third grids is alleviated (or eliminated). Furthermore, this provides the advantage of making it unnecessary to complicate the shape of the inner core pin needed in assembling the electrodes constituting an electron gun assembly.

On the other hand, in the conventional main electron lens of large aperture, since the opening between the electrodes has an elliptical shape in section long in the horizontal direction, the aperture of the lens in the vertical direction is much smaller than the aperture of the lens in the horizontal direction, causing a phenomenon where the electron beam spot on the screen Converges excessively in the vertical direction and insufficiently in the horizontal direction. To correct this phenomenon, an electric field correcting electrode plate is provided in a position back from the opening in the fifth grid (focus electrode). Holes bored separately for the respective three electron beams in the electrode plate are made extremely long vertically for their width, thereby correcting insufficient convergence in the horizontal direction and excessive convergence in the vertical direction. As a result of making smaller the horizontal diameter of the holes made separately for the respective three electron beams, local aberration components are given at the holes when the electron beams pass through the holes, with the present invention, however, since the lens components, which are common to the three electron beams and diverge relatively in the vertical direction and converge relatively in the horizontal direction, lie between the seventh grid (anode electrode) 7 and sixth grid (intermediate electrode) 6. Therefore, it is not necessary to make extremely small the diameter of the holes in the horizontal direction made in the electric field correcting electrode plate provided in the position back from the opening of the fifth grid (focus electrode) 5, thereby alleviating the local aberration components at the holes separately made for the respective three electron beams in the electric field correcting electrode plate provided in the position back from the opening in the fifth grid (focus electrode) 5, which realizes the main electron lens of large aperture.

In the embodiment of the present invention, a single intermediate electrode corresponding to the sixth grid 6 is incorporated in the electron gun assembly, however, it is possible to use an intermediate electrode structure including two or more intermediate electrodes instead of the single intermediate electrode.

As described above, a color cathode ray tube according to the present invention comprises an electron gun assembly including an electron beam generating section for emitting and forming three electron beams in in-line arrangement and a main electron lens section for converging the electron beams on a screen, and a deflection yoke for generating a deflection magnetic field to deflect the electron beams emitted from the electron gun assembly in the horizontal and vertical directions for scanning on a screen, wherein said main convergence lens of the electron gun assembly includes a focus electrode to which a medium focus voltage is applied, an anode electrode to which a high anode voltage is applied, and at least one intermediate electrode which is provided between the focus electrode and anode electrode and to which an medium high intermediate potential is applied, the intermediate potential being higher than the medium focus voltage and lower than the high anode voltage and obtained by dividing the high anode potential with a resistor provided near the electron gun assembly, and the opening section of the anode electrode and that of the intermediate electrode adjacent to each other are cylindrical units long in the in-line direction and common to the three electron beams and have a multiple pole lens provided between the adjacent anode electrode and intermediate electrode adjacent to each other, the multiple pole lens acting equally on the three electron beams and diverging relatively in the vertical direction and conversing relatively in the horizontal direction.

The color cathode ray tube is characterized in that the opening sections of the anode electrode and intermediate electrode adjacent to each other are cylindrical units long in the in-line direction and common to the three electron beams. As for the diameter of the openings in the direction crossing at right angles with the in-line direction of the cylindrical units, the diameter of the opening in the anode electrode is set smaller than that of the opening in the intermediate electrode to form a multiple pole lens common to the three electron beams.

With this configuration, a multiple pole lens which is common to the three electron beams and converge them relatively in the horizontal direction and diverge them relatively in the vertical direction is formed between the anode electrode and intermediate electrode adjacent to each other. At the same time, the diameter of the opening in the anode electrode in the vertical direction is smaller than the diameter of the opening in the intermediate electrode and the electric field penetrating into the intermediate electrode is pressed by the face of the anode electrode opposite the intermediate electrode, which makes the potential in the intermediate electrode denser than in the prior art. As a result, the lens between the focus electrode and intermediate electrode and the lens between the intermediate lens and anode electrode are connected to each other more easily to form a continuous lens than in the prior art. This makes it possible to make the length (L) of the intermediate electrode greater in the direction of electron beam advance without cutting off the connection of the two consecutive lenses in front of and behind the intermediate electrode, which provides the main electron lens of larger aperture.

With the present invention, a multiple pole lens common to three electron beams which converges the beams relatively in the horizontal direction and diverges them relatively in the vertical direction is formed between the seventh grid (anode electrode) 7 and sixth grid (intermediate grid) 6 adjacent to each other. This realizes the function of bending side beams toward the center beam positively in the main electron lens. As a result, the amount of the bend of a side beam toward the center beam before causing the side beams to enter the main electron lens is small (or there is no need to bend the side beams). Therefore, the aberration occurred in bending the side beams toward the center beam between the second and third grids or between the third and fourth grids and the fourth and the fifth grids is alleviated or eliminated. This provides the advantage of making it unnecessary to complicate the shape of the inner core pin needed in assembling the electrodes constituting an electron gun assembly.

Furthermore, with the present invention, since the lens components which are common to the three electron beams and diverge relatively in the vertical direction and converge relatively in the horizontal direction lie between the seventh grid (anode electrode) 7 and sixth grid (intermediate electrode) 6, it is not necessary to make extremely small the horizontal diameter of the holes made separately for the respective three electron beams in the electric field correcting electrode plate provided in the position back from the opening of the fifth grid (focus electrode) 5. This alleviates the local aberration components at the holes separately made for the respective three electron beams in the electric field correcting electrode plate provided in the position back from the opening of the fifth grid (focus electrode) 5, which realizes the main electron lens of large aperture.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

an electron gun assembly including an electron beam generating section for emitting and forming two side electron beams and a center electron beam in in-line arrangement and a main electron lens section for converging the center and side electron beams on a screen, and a deflection yoke for generating a deflection magnetic field to deflect the center and side electron beams emitted from the electron gun assembly in the horizontal and vertical directions for scanning on a screen, wherein said main convergence lens of said electron gun assembly includes a focus electrode to which a medium focus voltage is applied, an anode electrode to which a high anode voltage is applied, and at least one intermediate electrode which is provided between the focus electrode and anode electrode and to which a medium high intermediate potential is applied, the intermediate potential being higher than said medium focus voltage and lower than said high anode voltage and obtained by dividing the high anode potential with a resistor provided near the electron gun assembly, and the opening sections of the anode electrode and intermediate electrode adjacent to each other are each a cylindrical unit long in the in-line direction and common to the center and side electron beams and a multiple pole lens is provided between the anode electrode and intermediate electrode adjacent to each other, the multiple pole lens acting equally on the center and side electron beams, diverging each bundle of the center and side electron beams relatively in the vertical direction and converging each bundle of the center and side electron beams relatively in the horizontal direction so as to bend the side beams toward the center beam.

2. The color cathode ray tube according to claim 1, wherein the opening sections of said anode electrode and intermediate electrode adjacent to each other are each a cylindrical unit long in the in-line direction and common to the center and side electron beams, the opening section of the intermediate and anode electrode having horizontal diameter in the in-line direction DH, DH' and vertical diameter DV, DV' in the direction crossing at right angles with the in-line direction of the cylindrical units, respectively the horizontal diameter DH of the opening section of the anode electrode is substantially equal to the horizontal diameter DH' of the opening section of the intermediate electrode (DH≡DH'), and the vertical diameter DV of the opening section of the anode electrode is set than the vertical diameter DV' of the opening section of the intermediate electrode (DV>DV') to form the multiple pole lens common to the center and side electron beams.

* * * * *